United States Patent [19]

Theurer

[11] 4,357,874

[45] Nov. 9, 1982

[54] MOBILE ARRANGEMENT AND METHOD FOR IMPROVING A TRACK BED

[75] Inventor: Josef Theurer, Vienna, Austria

[73] Assignee: Franz Plasser Bahnbaumaschinen Industriegesellschaft m.b.H., Vienna, Austria

[21] Appl. No.: 208,191

[22] Filed: Nov. 19, 1980

[30] Foreign Application Priority Data

Jan. 15, 1980 [AT] Austria ..... 194/80

[51] Int. Cl.[3] ..... E01B 27/08

[52] U.S. Cl. ..... 104/2; 104/3; 171/16

[58] Field of Search ..... 104/2, 3, 7 R, 12; 171/16; 37/104–107

[56] References Cited

U.S. PATENT DOCUMENTS

| | | | |
|---|---|---|---|
| 3,872,929 | 3/1975 | Theurer et al. | 171/16 |
| 4,004,524 | 1/1977 | Scheughzer et al. | 104/2 |
| 4,178,995 | 12/1979 | Theurer et al. | 171/16 |

FOREIGN PATENT DOCUMENTS

| | | | |
|---|---|---|---|
| 307476 | 9/1972 | Austria | 104/2 |
| 2313055 | 9/1974 | Fed. Rep. of Germany | 104/3 |

*Primary Examiner*—Randolph Reese
*Attorney, Agent, or Firm*—Kurt Kelman

[57] ABSTRACT

A mobile arrangement for improving a track bed by interposing a layer of sand between the subgrade and ballast comprises a first self-propelled vehicle including a frame, a hoist mounted on the frame for lifting an assembled track section off the track whereby a trackless renewal section is created and a conveyor and discharge and distributing chute for ballast and sand, the vehicle frame having a length bridging the trackless renewal section and respective track sections adjoining the trackless renewal section at respective ends thereof in the regions of the vehicle frame ends. A second self-propelled vehicle includes a frame whose one end faces one end of the frame of the first vehicle in one of the adjoining track sections, a ballast excavating chain and a conveyor for the excavated ballast. A respective triple-undercarriage arrangement supports the one end of each vehicle frame, each triple-undercarriage arrangement consisting of two on-track undercarriages and an off-track undercarriage. Another undercarriage supports the frame of the first vehicle and the distance between the triple-undercarriage arrangement and the other undercarriage supporting the first vehicle frame exceeds the length of the assembled track section.

11 Claims, 6 Drawing Figures

MOBILE ARRANGEMENT AND METHOD FOR IMPROVING A TRACK BED

Figure 1:
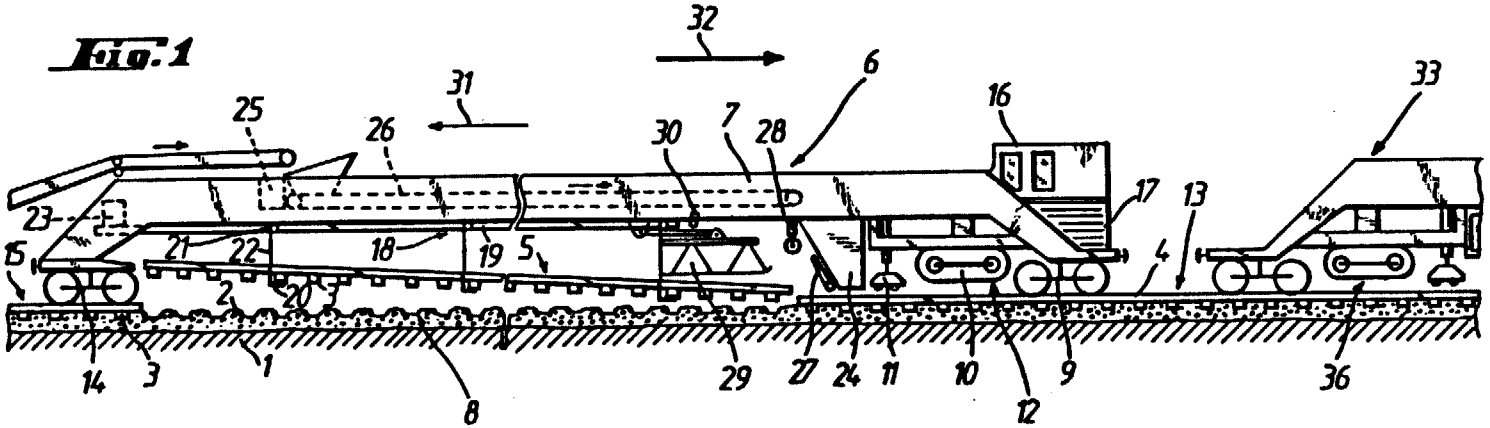

The present invention relates to a mobile arrangement for, and a method of, improving a track bed comprising a layer of ballast disposed on a subgrade by disposing a layer of a protective material, such as sand, between the subgrade and ballast.

Austrian Pat. No. 307,476, published Sept. 15, 1972, discloses a mobile ballast cleaning machine carrying means for applying a protective layer, such as a synthetic resin film, to the subgrade after the ballast has been excavated for cleaning and before the cleaned ballast is distributed over the protective layer. In this manner, the subgrade is protected against softening and the ballast bed is firmly supported on the protected subgrade.

An improvement over this system is provided by U.S. Pat. No. 3,872,929, dated Mar. 25, 1975, which discloses a ballast cleaning machine which first deposits a layer of sand on the ballast bed in the cribs, then excavates the ballast and the sand down to the subgrade, conveys the mixture of ballast and sand to a cleaning screen to separate the ballast from the sand, deposits the separated sand in a layer on the exposed subgrade and then deposits the separated ballast on the sand layer so that the layer of sand is interposed between the subgrade and the ballast bed. Before the ballast is distributed over the layer of sand, the sand layer is planed and compacted. While this track bed renewal system has been used with success, it usually requires cleaning of the excavated ballast because the latter was in contact with a softened subgrade and, therefore, is mixed with mud. Furthermore, the mixing and subsequent separation of the sand and ballast can be successfully effected only in dry weather since the sand must be in readily flowable condition.

U.S. Pat. No. 4,178,995, dated Dec. 18, 1979, discloses a self-propelled ballast cleaning machine for on- and off-track work to enable a trackless renewal section created by lifting a detached assembled track section off the ballast bed to be completely cleaned. The machine frame is supported at its respective ends by a respective triple-under-carriage arrangement consisting of two retractible on-track undercarriages and one retractible off-track undercarriage. This arrangement makes it possible to guide the ballast excavating means mounted on the frame between the triple-under-carriage arrangements towards an adjoining track section by selective operation of the on- and off-track undercarriages, i.e. by first engaging the rails of the adjoining track section with the wheels of one of the on-track undercarriages while the off-track track-laying undercarriage supports the machine frame, then retracting the off-track undercarriage as it moves over the adjoining track section and finally engaging the wheels of the second on-track undercarriage with the rails of the adjoining track section.

It is the primary object of this invention to provide a mobile arrangement for, and a method of, improving a track bed with an improved system of laying a protective layer between subgrade and ballast bed, and of the ballast itself.

The above and other objects are accomplished according to one aspect of the invention with a mobile arrangement which comprises a first self-propelled vehicle including a frame having two ends, a hoist mounted on the vehicle frame for lifting an assembled track section of the track bed whereby a trackless renewal section is created and means mounted on the vehicle frame for conveying, discharging and distributing ballast and protective particulate material, the vehicle frame having a length bridging the trackless renewal section and respective track sections adjoining the trackless renewal section at respective ends thereof in the regions of the vehicle frame ends. A second self-propelled vehicle includes a frame having two ends, one end of the frame of the first vehicle and one end of the frame of the second vehicle facing each other in one of the track sections adjoining the trackless renewal section, and means mounted on the frame of the second vehicle for excavating the ballast and for conveying the excavated ballast. A respective triple-undercarriage arrangement supports the one end of each vehicle frame, each triple-under-carriage arrangement consisting of two on-track undercarriages and an off-track undercarriage, and another undercarriage supporting the frame of the first vehicle, the distance between the triple-undercarriage arrangement and the other undercarriage supporting the first vehicle frame exceeding the length of the assembled track section.

This arrangement assures in a very simple manner a sharp separation between the layer of protective particulate material, such as sand, applied to the subgrade and the layer of ballast subsequently applied to the protective layer while each layer is homogenous, i.e. consists only of sand and ballast, respectively. Furthermore, since the protective particulate material and the ballast are separately conveyed and distributed, they cannot become bonded to each other in admixture, due to moisture, for example. The arrangement also is very simple and of robust construction, thus enhancing its efficiency.

The use of two independent self-propelled vehicles in this new mobile arrangement makes it possible to utilize very sturdy and relatively simple machines with generally well known and proven operating mechanisms for effectuating the track bed renewal work. Simple conveyor arrangements may be provided for efficiently conveying the excavated ballast from the renewal section and for delivering the protective material and the ballast to the renewal section after it has been excavated. Since the heavy hoist and excavating mechanisms are distributed over two vehicles, the vehicle carrying the hoist may be dimensioned for lifting and receiving relatively long assembled track sections while maintaining the required rigidity of the bridge-like vehicle frame. This makes the arrangement more economical.

According to another aspect of the present invention, the above-described mobile arrangement is used in a method of improving a track bed, which comprises the following successive steps: detaching an assembled track section from the track while leaving the detached track section in place; moving the first self-propelled vehicle in one direction over the detached assembled track section, the hoist being operated to lift the detached assembled track section off the track bed and to create the trackless renewal section and the first vehicle being moved further in the one direction over the trackless renewal section to the other adjoining track section by selective operation of the respective on- and off-track undercarriages thereof; moving the second self-propelled vehicle in the one direction over the trackless renewal section; operating the excavating means to excavate the ballast and operating the conveying means to convey the excavated ballast away from the second vehicle to remove the ballast from the trackless renewal section while moving the second vehicle in the opposite direction back to the one adjoining track section by selective operation of the respective on- and off-track undercarriages; moving the first vehicle in the opposite direction back over the trackless renewal section by selective operation of the respective on- and off-track undercarriages while operating the conveying, discharging and distributing means to convey, discharge and distribute protective particulate material over the subgrade in the trackless renewal section, and planing and compacting the distributed protective particulate material to provide the layer of protective particulate material; moving the first vehicle in the one direction over the trackless renewal section by selective operation of the respective on- and off-track undercarriages while operating the conveying, discharging and distributing means to convey, discharge and distribute ballast over the layer of protective particulate material; and moving the first vehicle again in the one direction over the trackless renewal section and operating the hoist to lower the lifted detached assembled track section onto the ballast.

If desired, an insulating web may be laid on the layer of protective particulate material as the first vehicle is moved in the one direction over the trackless renewal section and before the ballast is distributed.

This automatic track bed improvement method assures a greatly improved track bed renewal producing homogenous protective material and ballast layers. The resultant track bed is very durable and highly load-resistant. This is obtained because the protective particulate material and the ballast are handled completely separate from each other, being stored on separate freight cars and being separately conveyed therefrom to the trackless renewal section where they are separately and successively distributed one layer over the other. Furthermore, hoisting the assembled track section off the track bed and moving and heavy operating vehicles back and forth over the trackless renewal section assures a stronger compaction of the layers of protective particulate material and ballast in this section. The alternating movement of the two vehicles from adjoining track sections into the trackless renewal section and their alternating operation therein makes it possible to convey the large amounts of track bed materials without problems to the work site while removing the excavated ballast therefrom.

Figure 2:
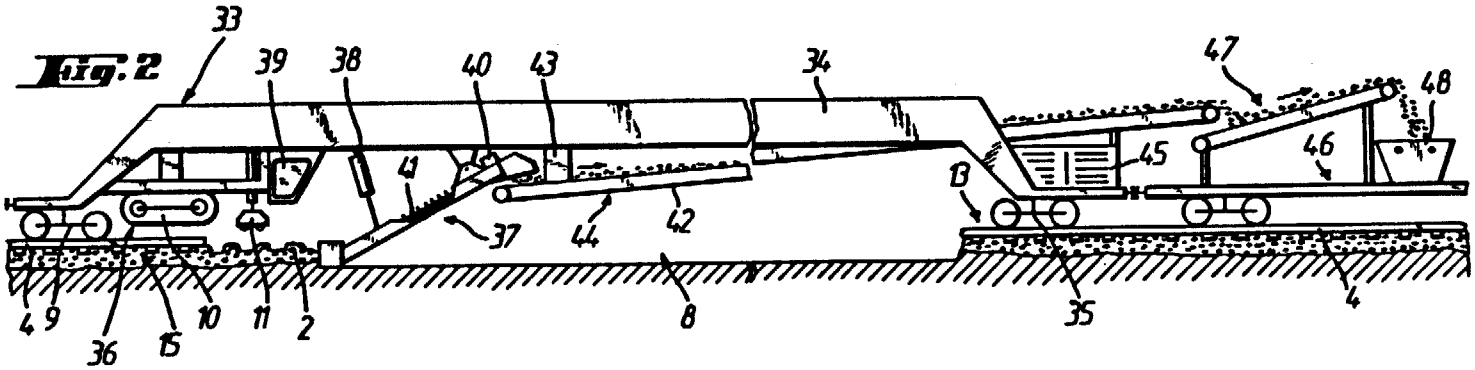
Figures 3, 4, 5, 6:
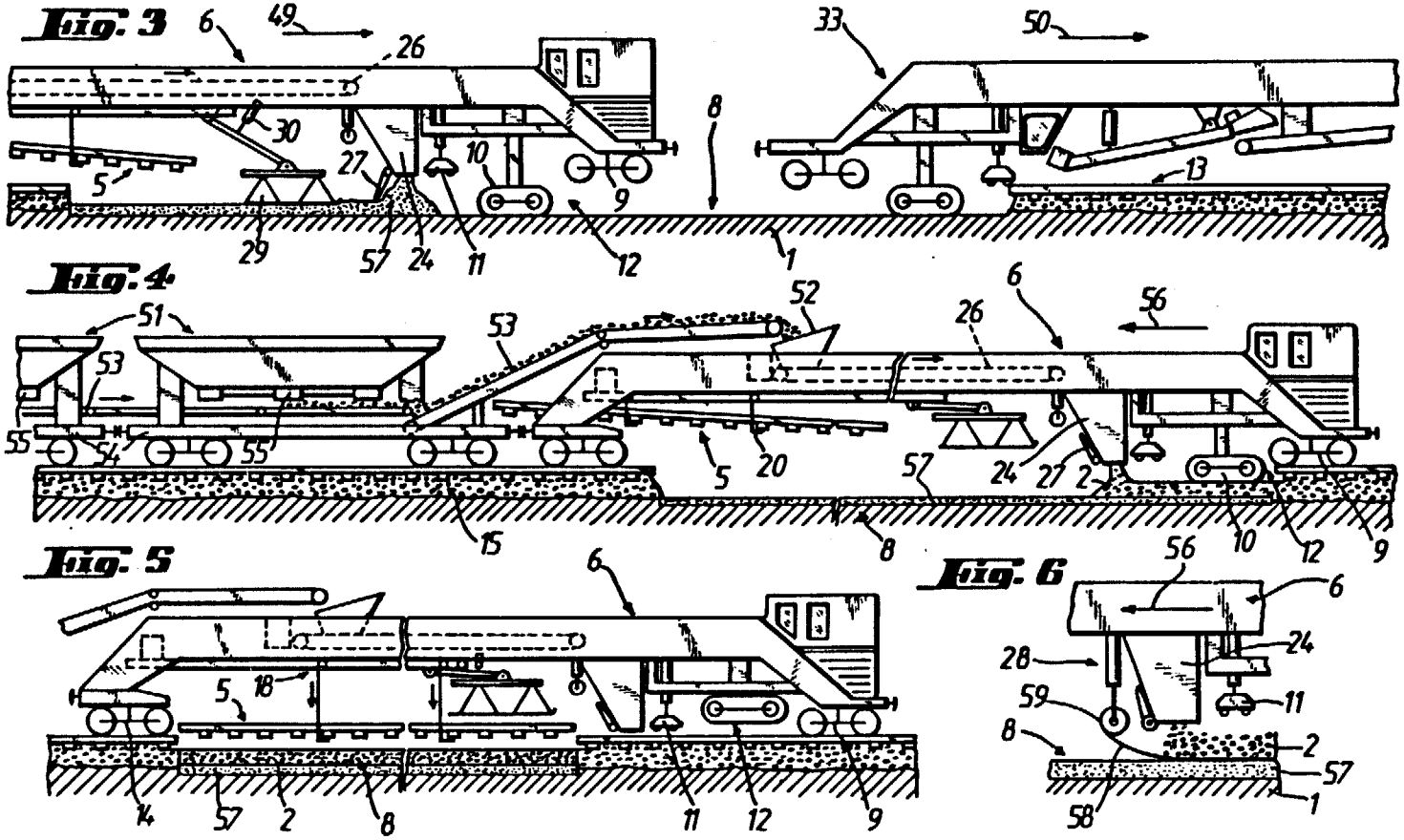

The above and other objects, advantages and features of this invention will become more apparent from the following detailed description of now preferred embodiments thereof, taken in conjunction with the accompanying schematic drawing wherein FIGS. 1 to 5 are side elevational views of the mobile arrangement of the invention and showing the various operating stages in the method of the present invention, and FIG. 6 is a fragmentary and enlarged side elevational view of a modification incorporating a means for providing an insulating web between the layer of protective material and ballast.

While the following description will use sand as the protective particulate material, since it is advantageous and most frequently used for this purpose, the protective particulate material may be sand mixed with bitumen, asphalt or the like, or bitumen, asphalt and the like alone.

Referring now to the drawing and first to FIG. 1, there is shown a track bed comprising a layer of ballast 2 disposed on subgrade 1. The track bed supports a track including ties 3 and rails 4 fastened thereto. At the working site, assembled track section 5 has been detached from the track and first self-propelled vehicle 6 has been moved over the detached assembled track section while the detached track section has been left in place. The assembled track section is detached from the track by removing fishplates at abutting rail section ends or, in case of welded rails, by cutting the rails at desired end points of the assembled track section.

First vehicle 6 includes frame 7 having two ends. Hoist 18 is mounted on vehicle frame 7 for lifting assembled track section 5 off the track bed whereby trackless track renewal section 8 is created, as shown in FIG. 1. In the illustrated embodiment, longitudinally extending guide track 19 is mounted on vehicle frame 7 for guiding hoist 18 therealong and drive 23 is associated with the hoist for displacing the hoist along the guide track. As shown in FIG. 3, this enables the lifted assembled track section to be displaced towards a remote end of the vehicle frame for unencumbered operation of various operating mechanisms to be described hereinafter without increasing the length of the frame, which would otherwise have to accommodate these mechanisms in addition to the length of the assembled track section. Vehicle frame 7 has a length bridging trackless renewal section 8 and respective track sections 13 and 15 adjoin trackless renewal section 8 at respective ends thereof in the regions of the vehicle frame ends.

The illustrated hoist comprises hook 20 for subtending and end of a selected tie of the assembled track section to engage the track section during lifting, the hook being suspended from cable 22 which is reeled on pulley 21. This hoisting arrangement forms a traveling winch functioning like the trolley of a crane. Drive 23 is arranged to rotate pulleys 21 and to displace them along guide track 19.

Means 26, 24 for conveying, discharging and distributing ballast and sand is mounted on vehicle frame 7, the preferred means illustrated herein comprising conveyor arrangement 26 and discharge and distributing chute 24, the conveyor arrangement being driven by drive 25 in the direction indicated by a small arrow in broken lines. Chute 24 is arranged immediately adjacent triple-undercarriage arrangement 12 supporting the end of vehicle frame 7 on track section 13. This compact structure makes it possible to reduce the length of the vehicle frame to the minimum length required to accommodate the lifted assembled track section and thus to increase its resistance to bending and torsion forces.

Triple-undercarriage arrangement 12 in a manner known from U.S. Pat. No. 4,178,995 consists of two on-track undercarriages 9, 11 and off-track undercarriage 10. Illustrated on-track undercarriage 9 is a double-axle swivel truck on which the vehicle frame is mounted and which has four flanged wheels for engagement with track rails 4 while retractible auxiliary on-track undercarriage 11 is mounted on frame 7 immediately adjacent chute 24. Off-track undercarriage 10 is retractibly mounted on the vehicle frame between the two on-track undercarriages and consists of a track-laying bogie. As shown in the drawing figures, as vehicle 6 is moved with its one end off track section 13 onto trackless renewal section 8 and off the trackless renewal section onto track section 15, and in reverse again, undercarriages 10 and 11 are selectively operated, i.e.

raised or lowered, to enable the one vehicle frame end to move on and off track, respectively. Another undercarriage 14, also illustrated as a double-axle swivel truck, supports frame 7 of vehicle 6 on track section 15, the distance between triple-undercarriage arrangement 12 and undercarriage 14 exceeding the length of the assembled track section 5.

Vehicle frame 7 carries operator's cab 16 which has a control panel for operating the various mechanisms mounted on the vehicle and drive 17 for triple-undercarriage arrangement 12, the drive and a suitable power plant being arranged below cab 16 so as to make the vehicle self-propelled.

The preferred mobile arrangement illustrated herein further comprises means 27 for planing the ballast or sand discharged and distributed by chute 24 and means 29 for compacting the planed ballast or sand. The illustrated planing means is blade 27 pivotally mounted on chute 24 and the illustrated compacting means is a surface compactor 29 vertically movably mounted on frame 7 by hydraulic drive 30. In this manner, the distributed sand and/or ballast may be planed and/or compacted immediately after being discharged from and distributed by chute 24. The compact arrangement of all these mechanisms immediately adjacent each other again aids in desirably reducing the length of the vehicle frame.

As shown partially at the right of FIG. 1 and fully in FIG. 2, the mobile arrangement further comprises second self-propelled vehicle 33 including frame 34 having two ends. The one end of frame 7 of first vehicle 6 and one end of frame 34 of second vehicle 33 face each other in the one track section 13 adjoining trackless renewal section 8. Means 37, 44 are mounted on frame 34 of second vehicle 33 for excavating ballast 2 and for conveying the excavated ballast. Triple-undercarriage arrangement 36 supports the one end of vehicle frame 34 and consists of two on-track undercarriages 9, 11 and off-track undercarriage 10 structured and operating in the same manner as triple-undercarriage arrangement 12 described hereinabove. Another undercarriage 35, also illustrated as a double-axle swivel truck, supports the other end of vehicle frame 34 on track section 13. The illustrated ballast excavating and conveying means comprises excavating chain 41 having a transverse section extending over the width of the track bed and arranged immediately adjacent triple-undercarriage arrangement 36 and conveyor arrangement 42 comprised of an endless conveyor band arranged to receive the excavated ballast from the excavating chain. The excavating chain is driven by motor 40 and the endless conveyor band is driven by motor 43, hydraulic motor 38 being linked to excavating chain 41 for raising and lowering the same into and out of operating position. This again provides a very compact arrangement of all operating mechanisms and reduces the length of the vehicle frame and the excavating chain removes the ballast over the entire width of the bed.

As shown more clearly in FIG. 6, in a modified embodiment of the mobile arrangement of the present invention, device 28 is arranged immediately adjacent discharging and distributing chute means 24 and planing means 27 on frame 7 of first vehicle 6 for continously unreeling insulating web 58 dispensed from roll 59, thus laying an insulating layer between sand layer 57 and ballast 2. The insulating layer may be a film of synthetic resin, for example, and this modified embodiment enables such an insulating layer to be laid without requiring additional time.

Operator's cab 39 is mounted on frame 34 of second self-propelled vehicle 33 within sight of the excavating chain for ready operation of vertical adjustment drive 38 so as to position the excavating chain properly and drive and power plant 45 for the vehicle is mounted over undercarriage 35 on the vehicle frame. Partially illustrated freight car 46 is coupled to the end of vehicle frame 34 supported by swivel truck 35 and carries further conveyor arrangement 47 which has one end receving the excavated ballast from endless conveyor band 42 driven in the direction of the small arrow shown in FIG. 2 above this conveyor band and another end discharging the excavated ballast into receptacle 48 mounted on freight car 46. Additional freight cars may be coupled to this train and gantry cranes may remove full receptacles from freight car 46 and position empty receptacles thereon to be filled in succession.

The method of improving a track bed according to this invention proceeding in the direction of arrow 32 shown in FIG. 1, from stage to stage, will now be described in connection with the drawing figures. After assembled track section 5 has been detached, although left in place, and first self-propelled vehicle 6 has been moved over the detached assembled track section, as shown in FIG. 1, vehicle 6 is moved in one direction indicated by arrow 31 over the detached assembled track section, hoist 18 being operated to lift detached assembled track section 5 off the track bed and to create trackless renewal section 8, and vehicle 6 is moved further in this one direction over trackless renewal section 8 to adjoining track section 15 by selective operation of respective on- and off-track undercarriages 11, 10, 9. This selective operation includes lowering off-track undercarriage 10 into engagement with the ballast as this undercarriage leaves the range of track section 13 and reaches the trackless renewal section. As vehicle 6 proceeds further in the direction of arrow 31, it is supported at one end on track section 15 by on-track undercarriage 14 while its other end is supported on trackless renewal section 8 by track-laying bogie 10. As this other end approaches track section 15 and auxiliary on-track undercarriage 11 reaches its range, it is lowered onto the track for support of the other end thereon. On further movement of vehicle 6 in the direction of arrow 31, off-track undercarriage 10 is raised and swivel truck 9 will come into engagement with the track so that vehicle 6 will be supported on track section 15 by on-track undercarriages 14 and 9. As shown in FIG. 1, the assembled track section is lifted a little higher over swivel truck 14 and the hoist is moved along guide track 19 to dispose the assembled track section so as to enable mechanisms 24, 27, 28 (if used) and 29 to operate.

While this movement has proceeded, second self-propelled vehicle 33 is moved also in the one direction over trackless renewal section 8 into the position shown in FIG. 2. This movement also is effected by the selective operation of the on- and off-track undercarriages of triple-undercarriage arrangement 36 in the manner explained hereinabove to enable the vehicle end supported by this triple-undercarriage arrangement to pass through the transition points between the track sections and the trackless renewal section.

As indicated in FIG. 2, excavating means 37 and conveying means 44 are operated to excavate ballast 2 and to convey the excavated ballast away from second vehicle 33 to remove the ballast from trackless renewal section 8 while the second vehicle is moved in the one direction indicated by arrow 31 in FIG. 1, to adjoining track section 15 by the same selective operation of respective on- and off-track undercarriages 10, 11. After the ballast has been removed, first vehicle 6 and second vehicle 33 are moved in the opposite direction, indicated by arrows 49 and 50, by this selective operation of the respective on- and off-track undercarriages.

As shown in FIG. 4, freight cars 51 are coupled to first vehicle 6 and their frames 54 carry hoppers respectively holding a supply of ballast and sand. The hoppers have discharge outlets 55 at their bottoms, which are preferably remote-controlled to open respective outlets for discharging either sand or ballast onto endless conveyor band 53 disposed below the outlets and conveying the discharged ballast or sand to conveyor arrangement 53 which conveys the ballast or sand to hopper 52 dispensing the ballast or sand to conveyor arrangement 26 on first vehicle 6. The conveying, discharging and distributing means are operated while vehicle 6 moves in the direction of arrow 49 (see FIG. 3) to convey, discharge and distribute the sand over subgrade 1 in trackless renewal section 8 to lay down protective sand layer 57. At the same time, planing blade 27 is pivoted into position to plane the sand layer and surface compactor 29 is lowered into engagement with planed sand layer 57 to compact the same and to provide the desired layer of protective material, i.e. sand.

With the freight cars coupled to the first and second self-propelled vehicles and the continuous conveyance of the ballast or sand to the first vehicle and the excavated ballast from the second vehicle, a smooth and efficient operation of the entire mobile track bed improvement system of this invention is assured without blocking a neighboring track.

After sand layer 57 has been applied, planed and compacted over the subgrade in the entire trackless renewal section, first vehicle 6 is moved again in the one direction indicated by arrow 56 in FIG. 4 while operating the conveying, discharging and distributing means to convey, discharge and distribute ballast 2 over the sand layer, outlets 55 of hoppers 51 containing sand having been closed and the outlets of the hoppers containing ballast having been opened to convey ballast by conveying means 53, 26 instead of sand. As shown in FIG. 4, track-laying bogie 10 moves over the layer of ballast 2 distributed through chute 24, applying the full load of vehicle 6 carrying assembled track section 5 to the ballast and thus compacting the same along two strips on which the rails will come to rest.

As shown in FIG. 5, the first vehicle is then again moved in the one direction over trackless renewal section 8 and hoist 18 is operated to lower lifted assembled track section 5 onto ballast 2. The emplaced assembled track section is then fastened to the ties again and the entire mobile arrangement is moved in the direction of arrow 32 sufficient to place first vehicle 6 over the next assembled track section 5 to be detached for improving the track bed under the succeeding track section.

This method produces very homogenous sand and ballast layers in the track bed and the bed is not only highly resistant to loads but will remain so for a long time. This is accomplished by strictly separating the conveyance and application of the sand and ballast layers in succeeding operating stages, the sand and ballast being stored in separate receptacles and being conveyed and distributed separately. Also, the method assures a very good compaction of the applied protective and ballast layers. Since the two vehicles used for lifting the assembled track section and laying the sand and ballast layers, on the one hand, and excavating and removing the ballast, on the other hand, are used in alternate stages, there is no problem in delivering the large amounts of sand and/or ballast and of removing the large amounts of ballast. Furthermore, as best shown in FIG. 6, the method lends itself readily to the laying of an insulating web between the sand and ballast layers.

If desired, application of sand layer 57 may be omitted and only insulating web 58 may be applied directly to subgrade 1. Also, instead of using sand as protective material, bitumen, asphalt or like materials may be used alone or in admixture with sand. Furthermore, vehicle 33 could be replaced by a suitable ballast cleaning machine, such as the one exemplified in U.S. Pat. No. 4,178,995.

Also, the detached assembled track section may be removed to a suitable freight car coupled to the mobile arrangement by a gantry crane or the like known in this art and a new assembled track section may be conveyed to the first vehicle to be laid on the improved track bed. No extra time will thus be needed for providing a fully new track with the arrangement and method of the invention.

What is claimed is:

1. A mobile arrangement for improving a track bed comprising a layer of ballast disposed on a subgrade by disposing a layer of a protective material between the subgrade and the ballast, which is essentially comprised of two vehicles consisting of (a) a first self-propelled vehicle including a frame having two ends,
  (1) a hoist mounted on the vehicle frame for lifting an assembled track section off the track bed whereby a trackless renewal section is created and
  (2) means mounted on the vehicle frame for conveying, discharging and distributing ballast and protective material,
  (3) the vehicle frame having a length bridging the trackless renewal section and respective track sections adjoining the trackless renewal section at respective ends thereof in the regions of the vehicle frame ends,
(b) a second self-propelled vehicle including a frame having two ends, one end of the frame of the first vehicle and one end of the frame of the second vehicle facing each other,
  (1) means mounted on the frame of the second vehicle for excavating the ballast and for conveying the excavated ballast,
(c) a respective triple-undercarriage arrangement supporting the one end of each vehicle frame, each triple-under-carriage arrangement consisting of two separately operable on-track undercarriages and an off-track undercarriage therebetween, and
(d) another undercarriage supporting the frame of each vehicle, the distance between the triple-undercarriage arrangement and the other undercarriage supporting each vehicle frame exceeding the length of the assembled track section.

2. The mobile track bed improving arrangement of claim 1, wherein the means for conveying, discharging and distributing ballast and protective material comprises a conveyor arrangement and a discharge and distributing device, the discharge and distributing device being arranged immediately adjacent the triple-undercarriage arrangement supporting the one end of the frame of the first vehicle.

3. The mobile track bed improving arrangement of claim 1 or 2, further comprising a means for planing the ballast or protective material discharged and distributed by the discharging and distributing means.

4. The mobile track bed improving arrangement of claim 1 or 2, further comprising a means for compacting the ballast or protective material discharged and distributed by the discharging and distributing means.

5. The mobile track bed improving arrangement of claim 2, further comprising a means for planing the ballast or protective material discharged and distributed by the device and a means for compacting the planed ballast or protective material mounted on the vehicle frame immediately adjacent the device.

6. The mobile track bed improving arrangement of claim 1, further comprising a longitudinally extending guide track mounted on the vehicle frame of the first vehicle for guiding the hoist therealong and a drive for displacing the hoist along the guide track.

7. The mobile track bed improving arrangement of claim 1, wherein the means for excavating the ballast and for conveying the excavated ballast comprises an excavating chain having a transverse section extending over the width of the track bed and arranged immediately adjacent the triple-undercarriage arrangement supporting the one end of the frame of the second vehicle and a conveyor arrangement arranged to receive the excavated ballast from the excavating chain.

8. The mobile track bed improving arrangement of claim 1, further comprising freight cars coupled respectively to the first and second vehicles, the freight cars coupled to the first vehicle carrying a supply of ballast and protective material and a conveyor means arranged to convey said supply to the conveying means mounted on the frame of the first vehicle, and the freight car coupled to the second vehicle carrying a conveyor means arranged to receive the conveyed excavated ballast from the second vehicle.

9. The mobile track bed improving arrangement of claim 1, further comprising a device arranged immediately adjacent the discharging and distributing means on the frame of the first vehicle for continuously unreeling an insulating web.

10. A method of improving a track bed comprising a layer of ballast disposed on a subgrade by disposing a layer of a protective material between the subgrade and the ballast, which comprises the following successive steps:

(a) detaching an assembled track section from the track while leaving the detached track section in place, (b) moving a first self-propelled vehicle in one direction over the detached assembled track section, the vehicle including (1) a frame having two ends, (2) a hoist mounted on the vehicle frame for lifting the detached assembled track section off the track bed whereby a trackless renewal section is created, (3) means mounted on the vehicle frame for conveying, discharging and distributing ballast and protective material, (4) the vehicle frame having a length bridging the trackless renewal section and respective track sections adjoining the trackless renewal section at respective ends thereof in the regions of the vehicle frame ends, (5) a triple-undercarriage arrangement supporting one end of the vehicle frame on one of the adjoining track sections and consisting of two on-track undercarriages and an off-track undercarriage, and (6) another undercarriage supporting the frame, the distance between the triple-undercarriage arrangement and the other undercarriage exceeding the length of the assembled track section, (c) operating the hoist to lift the detached assembled track section off the track bed and to create the trackless renewal section, and moving the vehicle further in said one direction over the trackless renewal section to the other adjoining track section by selective operation of the respective on- and off-track undercarriages, (d) moving a second self-propelled vehicle in the one direction over the trackless renewal section, the vehicle including (1) a frame having two ends, the one end of the frame of the first vehicle and one end of the frame of the second vehicle facing each other, (2) means mounted on the frame of the second vehicle for excavating the ballast and for conveying the excavated ballast, and (3) a triple-undercarriage arrangement supporting the one end of the frame of the second vehicle and consisting of two on-track undercarriages and an off-track undercarriage, (e) moving the second vehicle in the one direction over the trackless renewal section by selective operation of the respective on- and off-track undercarriages, (f) operating the excavating means to excavate the ballast and operating the conveying means to convey the excavated ballast away from the second vehicle to remove the ballast from the trackless renewal section while moving the second vehicle in the one direction to the one adjoining track section by selective operation of the respective on- and off-track undercarriages, (g) moving the first vehicle in a direction opposite to the one direction back over the trackless renewal section by selective operation of the respective on- and off-track undercarriages while operating the conveying, discharging and distributing means to convey, discharge and distribute protective particulate material over the subgrade in the trackless renewal section, and planing and compacting the distributed protective particulate material to provide the layer of protective material, (h) moving the first vehicle in the one direction over the trackless renewal section by selective operation of the respective on- and off-track undercarriages while operating the conveying, discharging and distributing means to convey, discharge and distribute ballast over the layer of protective material, and (i) moving the first vehicle again over the trackless renewal section and operating the hoist to lower the lifted detached assembled track section onto the ballast.

11. The track bed improving method of claim 10, further comprising the step of laying an insulating web on the layer of protective material as the first vehicle is moved in the one direction over the trackless renewal section and before the ballast is distributed.

* * * * *